United States Patent [19]

Kraus et al.

[11] 4,414,900

[45] Nov. 15, 1983

[54] NON-LEAKING PRINTING INK TROUGH

[75] Inventors: Josef Kraus; Erich Wech, both of Augsburg, Fed. Rep. of Germany

[73] Assignee: M.A.N. Roland Druckmaschinen Aktiengesellschaft, Offenbach am Main, Fed. Rep. of Germany

[21] Appl. No.: 314,218

[22] Filed: Oct. 23, 1981

[30] Foreign Application Priority Data

Nov. 15, 1980 [DE] Fed. Rep. of Germany ..... 3043234

[51] Int. Cl.[3] ..... B41F 1/46; B41F 31/02

[52] U.S. Cl. ..... 101/363; 101/364

[58] Field of Search ..... 101/207, 208, 210, 348, 101/349, 350, 355, 356, 360, 363, 364

[56] References Cited

U.S. PATENT DOCUMENTS

| | | | |
|---|---|---|---|
| 1,469,544 | 10/1923 | Swaim | 101/364 |
| 2,922,364 | 1/1960 | Nitchie et al. | 101/350 |
| 3,135,197 | 6/1964 | Dutro et al. | 101/364 |
| 3,176,611 | 4/1965 | Tripp | 101/364 |
| 3,318,239 | 5/1967 | Wintzer | 101/364 |

FOREIGN PATENT DOCUMENTS

| | | | |
|---|---|---|---|
| 151356 | 6/1951 | Australia | 101/364 |

*Primary Examiner*—Edgar S. Burr
*Assistant Examiner*—John A. Weresh
*Attorney, Agent, or Firm*—Frishauf, Holtz, Goodman & Woodward

[57] ABSTRACT

Lateral escape of ink from between the end face (A) of a duct roller (1) and the side wall (3) retaining the duct roller is prevented by extending the length of the duct blade (11) beyond the axial extent of the duct roller and placing an end wall portion (4) in the end wall which is resiliently pressed against the end face (A) of the duct roller and, further, resiliently engaged with the top face of the duct blade (11) to form a tight seal and prevent escape of ink laterally from between the duct blade (11) and the duct roller (1). The resilient portion is plate-like, and the sealing strip preferably is a generally T-shaped element, in which the leg portion of the T is clamped to both the resilient portion (4) of the end wall and the fixed portion (3) thereof, while permitting relative movement of the two elements.

8 Claims, 3 Drawing Figures

NON-LEAKING PRINTING INK TROUGH

REFERENCE TO PRIOR PATENT

German Patent Publication No. DE-AS 11 62 852.

The present invention relates to printing machinery, and more particularly to an ink trough for printing machines in which a duct roller operates within an ink trough, and ink is stripped off by a doctor blade therefrom, the ink trough being defined by an elongated cross element, or cross trough member, and sidewalls, and more particularly to a construction to eliminate leakage of ink at the side walls.

BACKGROUND

Various types of ink troughs are used in the printing field, and reference is made to German Patent Publication DE-AS No 11 62 852. The ink trough there disclosed has lateral sides which include elastic material forming bearing shoes and having end portions which match the circumference of the duct roller. The ink duct blade is located between the side walls and fits with its end walls against the side walls and the bearing shoes secured thereto. The engagement surface between the duct blade and the shoes causes problems, however, since, due to manufacturing tolerances and changes in elongation, for example under heating of the ink and the operating components, ink can ooze or leak out of a gap which can form between the end of the duct blade and the shoes or side walls forming and limiting the lateral end of the ink trough.

THE INVENTION

It is an object to eliminate leakage of ink from an ink trough of the general type above referred to by so improving the arrangement thereof that no ink can flow out between the end of the blade and the remainder of the ink trough.

Briefly, the doctor blade is made longer than the duct roller; a portion of the side walls is elastically movable; it fits against the end walls of the duct roller and further has a resilient element which presses against one of the faces of the blade. By resiliently floatingly arranging the movable portion in form of an inner component of the side wall, self-adjustment with respect to the fixed side wall, yet tight fit of this resilient, movable floating component against the duct roller and the blade can be obtained, so that leakage of ink out of the trough is reliably prevented.

DRAWINGS

Figure 1:
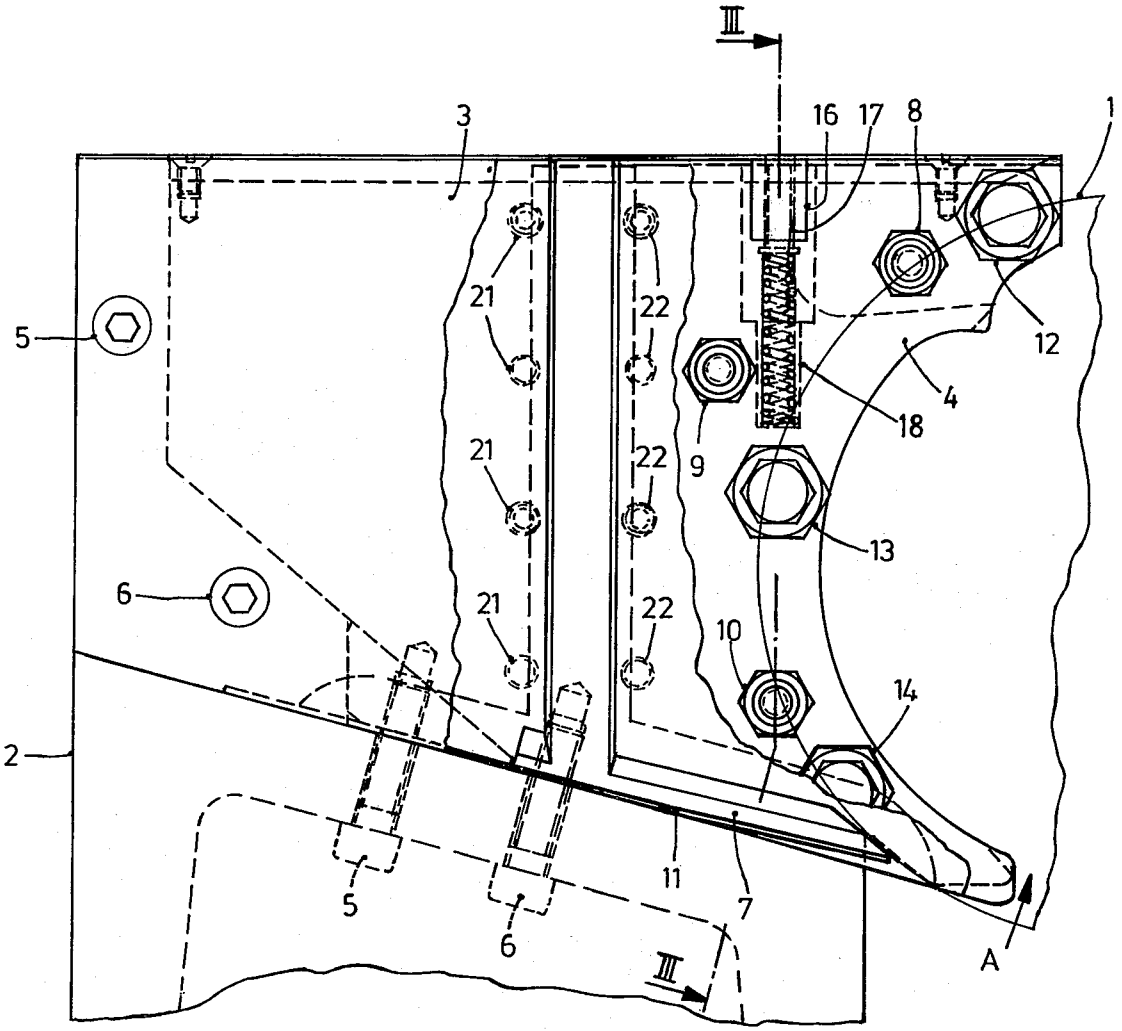
FIG. 1 is a side elevational view of the ink trough.

The ink trough—see FIG. 1—cooperates with a duct roller 1 and, as is customary, is formed of a cross element or cross member 2 extending in axial direction parallel to the duct roller 1. The cross element 2 is inclined downwardly towards the duct roller 1 and defines, with side walls 3, an ink trough. The front wall—in FIG. 1 the right side—of the ink trough is defined by the duct roller 1 itself, the bottom wall by the cross element 2; and a back element may be used, or not, as desired, and in accordance with standard construction. The back element, not forming a part of the invention, is shown only schematically in FIG. 1, and not further identified.

Each side wall has an outer closing element 3 which is securely connected to the cross element 2 by suitable connection elements, for example bolts 5, 6.

Figure 2:
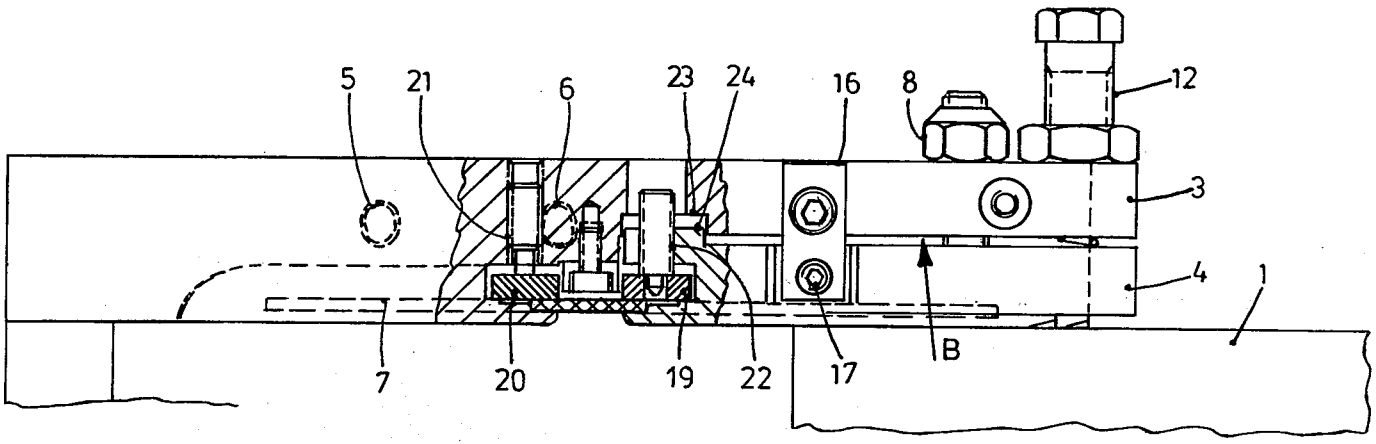
FIG. 2 is a top view of an end element or end wall of the ink trough.
Figure 3:
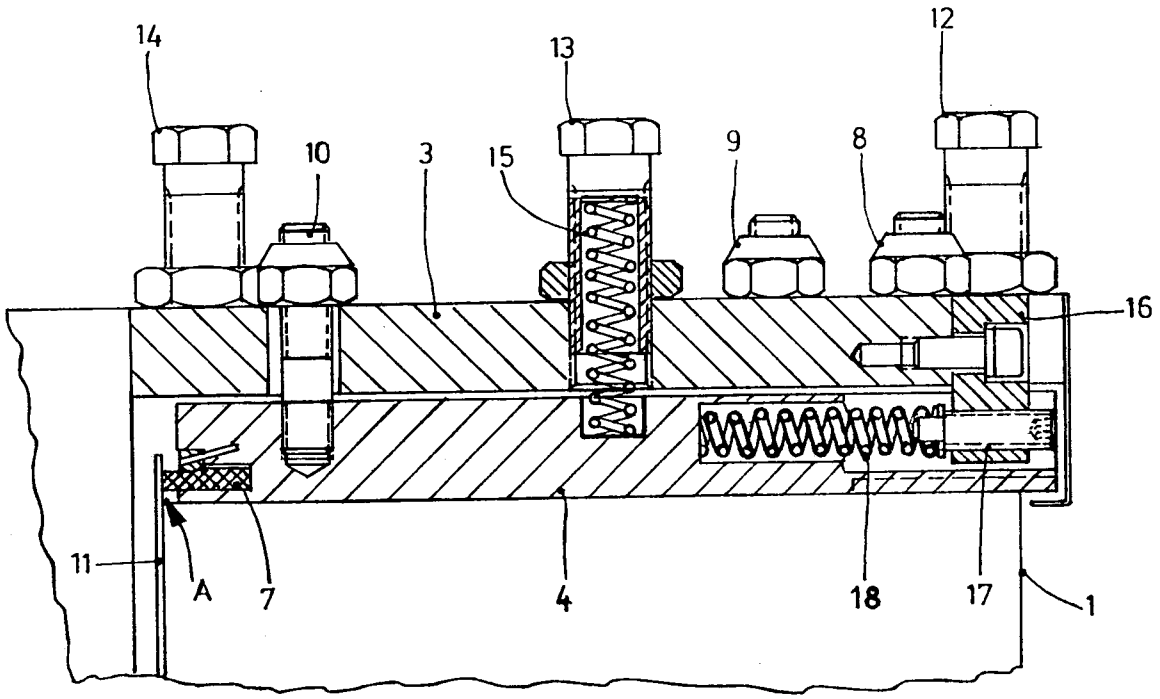
FIG. 3 is a cross-sectional view along the angled plane III—III of FIG. 1.

In accordance with a feature of the invention, the end element 3 includes an inner closing element 4 (FIGS. 2, 3) which is secured in position by screws 8, 9, 10 having outer nuts thereon—see, for example, FIGS. 2, 3. The side walls, thus, form an assembly which includes the outer elements 3 and the inner elements 4, which are perpendicularly positioned with respect to a duct or doctor blade 11. In accordance with the invention, the doctor blade 11 is longer than the axial extent of the duct roller 1, so that it extends with its end portions beyond the end face A—FIGS. 1, 3—of the duct roller. The end elements 3, 4, as best seen in FIG. 3, are connected together by the screws 8, 9, 10 which are tapped into the inner element 4—see FIG. 3—but can pass through an enlarged opening within the outer element 3, so that element 4 can move laterally (FIG. 3) with respect to outer element 3. The nuts on screws 8, 9, 10 are not tightened against element 3, but provide a limit abutment surface for movement of the element 4, as will appear.

The inner end wall or element 4 is a plate element which (FIGS. 2, 3) can be pressed against the end face A of the duct roller 1 and, thereby, is positioned at least approximately perpendicularly to the doctor blade 11—see FIG. 3—which is clearly shown to be longer than the duct roller 1, and thus extends beyond the end face A of the duct roller 1. Positioning screws 12, 13, 14—FIGS. 1, 3—are screwed into the outer end wall or element 3. The positioning screws 13, 13, 14, preferably, are formed with a blind inner bore in which compression springs 15 are positioned, fitted into receiving recesses formed in the inner end element 4—see FIG. 3. The compression springs 15 thus, elastically movable the inner element 4 against the end face A of the duct roller 1. The force of engagement is adjustable by positioning the screws 12, 13, 14, which can be locked in place by a lock nut. The arrangement has the advantage that, even upon change in the elongation of the duct roller 1, due to thermal expansion, the end element 4 is always elastically engaged with the end face A of the duct roller and, upon heating, the inner element 4 can move axially towards the outer element 3, while maintaining exact and tight sealing engagement with the end face A of the duct roller. Danger of jamming of the end element 4 against the duct roller 1 is thereby avoided and, additionally, any eccentricities are automatically compensated. Preferably, the surface of the inner end element 4 fitting against the end face A of the duct roller 1 is coated or covered with a wear-resistant layer which has good sliding, low-friction characteristics, for example Teflon, or low-friction metal-to-metal sealing materials.

The outer element 3 has a holder 16 secured thereto which supports a threaded pin 17 engaging a compression spring 18, fitting with its inner end—see FIG. 3—into a matching recess or blind bore within the end element 4. The direction of the spring pressure of spring 18 is such that the end element 4 is pressed elastically movable against the top face of the blade 11 (see FIG. 3). This insures permanent and leakage-proof connection between the inner end element 4 and the blade 11. The force of engagement between the element 4 and the end face A of the duct roller 1 is adjustable by the screws 12, 13, 14, as well as by the screws 8, 9, 10; the force of engagement of the inner end wall element 4 against the blade 11 is adjustable by the screw 17 in engagement with spring 18. Screws 8, 9, 10 push against spring 15. Thus, inner wall portion 4 is pressed elastically, movably (a) against the end face A of duct roller 1 by springs 15 in screws 12, 13, 14; and (b) against the top face of blade 11 by springs 18 in screws 17, via an interposed seal 7.

In accordance with a feature of the invention, the inner end element 4 and the outer end element 3 are maintained in aligned, guided position by a recess B (FIG. 2) formed in the outer element 3 which receives the inner element 4—see so that the inner sides of the end elements 3, 4 are in approximately the same plane. The sides of the end elements 3, 4 are each formed with a groove in which the seal 7 is so positioned that it extends over the entire depth of the blade 11 to provide tight and exact sealing with respect thereto over the entire axial length of the duct roller 1 thereto. Simultaneously, and as seen in FIG. 2, the sealing strip 7 seals the space between the end elements 3, 4. The point of exit of the sealing element 7 from the groove of the inner element 4' and the entry in the groove of the end wall, or outer element 3 are so far spaced from each other that a relative movement of the inner element 4 with respect to the outer element 3 over the sealing strip 7, which is perpendicular to that movement, is possible. Thus, and due to the effect of the spring 18—FIG. 3—permanent engagement of the inner end wall element 4 on the blade 11 via the seal 7 is insured. Sealing strip 7, in plan view, is generally T-shaped (FIG. 1).

The leg formed by the "T" seal 7—see FIG. 1—is clamped by clamping strips 19, 20—see FIG. 2—by threaded pins 21, 22 and pressed against the closing elements 3, 4 in order to obtain a reliable seal throughout. The cross bar of the T-element engages the blade 11. The inner end wall element 4, in accordance with a feature of the invention, is guided for movement relative to the outer element 3 by a projection-and-recess engagement, shown as a groove 23 in the outer element 3 which is engaged by a corresponding projecting ridge 24 in the inner element 4—see FIG. 2.

The inner end wall element 4, in the region of the ink duct roller—duct blade engagement zone, is preferably narrow, so that only that narrow portion will be in contact with the blade 11. The advantage of this arrangement is prevention of a gap in case the blade 11 should skew longitudinally and thus prevention of escape of ink.

At the position in which the blade 11 is closest to, that is, almost engages the duct roller 1—looked at from the end face—engagement the end element 4 is in with the blade 11, see FIG. 3. The compression spring 18 effects this engagement by pressing the end wall element 4 towards the blade 11, so that sealing element 7 is pressed on blade 11. The element 4 is formed with an inclined wall at that point which corresponds, approximately at least, to the angle which is defined by the engagement angle of the blade 11 with the duct roller 1. Actual sealing engagement is effected by the sealing element 7, secured to the inner end wall element 4 as best seen in FIG. 3.

It may occur that the blade 11 is bowed through, so that the end portions of the blade 11 are slightly raised with respect to the central portion, thus causing a gap to occur between the end elements and the blade. The structure of the present invention prevents formation of any gap, since the inner end element 4 is permanently pressed by the spring 18 over the entire region thereof, to effect, through the resilient element 7, sealing of the inner element 4 against the blade 11, regardless of its position. Assembly and disassembly of the side walls of the ink trough, for example for cleaning or replacement, is simple, and can be carried out by loosening only a few screws, for example the screws 5, 6, and further disassembly can readily be effected by removal of the screws 8, 9, 10, and releasing spring tension on the springs 15 within the screws 12, 13, 14.

The sealing strip 7 can be retained within the inner end element 4 in a groove—see FIG. 3—and wedged in position by a small wedging strip retained, for example, by pins, or projections molded on the wedging strip.

Various changes and modifications may be made within the scope of the inventive concept.

We claim:

1. Non-leaking printing ink trough construction having an elongated cross element (2);

an ink duct roller (1) extending parallel to the cross element and having an end face at each end;

a doctor blade (11) extending parallel to the ink duct roller;

a side wall positioned perpendicularly to the cross element, closing off the cross element laterally, and forming therewith an ink trough construction in engagement with the end faces of the duct rather, said side wall including a fixed wall portion (3) and an elastically movable wall portion (4) in engagement with a duct roller end face (1), the doctor blade (11) being longer than the duct roller (1) to form lateral projecting portions;

a resilient force means (18), coupled to the elastically movable wall portion (4) to press said elastically movable wall portion against the top face of the doctor blade (11);

and spring means (15) bearing on the elastically movable wall portion (4) of the side wall for pressing said elastically movable wall portion into engagement with an end face (A) of the duct roller (1), said movable portion thus sealing (a) against the end face (A) of the duct roller (1) and (b) against the top face of the doctor blade (11)

to form a non-leaking end seal;

and a sealing element (7) which, in plan view, is essentially T-shaped, having a cross portion and a leg portion, said cross portion forming a seal between the fixed and the elastically movable wall portions of the side wall and the blade (11), and the leg portion extending between and sealingly connecting said fixed portion and said elastically movable wall portion, while permitting movement of the elastically movable wall portion (4) with respect to the fixed portion (3) and movement of the elastically movable wall portion (4) in the direction of the leg portion of the sealing element (7).

2. Construction according to claim 1, wherein the side wall fixed portion (3) being secured to the cross element (2);

and the spring means (15) interconnect said elastically movable wall portion (4) and the fixed portion (3) bearing against the fixed portion and exerting resilient spring pressure against the elastically movable wall portion to press the elastically movable wall portion against the end face (A) of the ink duct roller (1).

3. Construction according to claim 2, further including positioning bolts (8, 9, 10) connecting the elastically movable wall portion (4) and the fixed portion of the side wall, and positioning the elastically movable wall portion counter the force of the spring means (15) with respect to the fixed portion to locate the elastically movable wall portion in a predetermined range of positions with respect to the fixed portion.

4. Construction according to claim 1, wherein said resilient force means (18) comprises compression spring means (18);

said side wall fixed portion (3) being secured to said cross element and said elastically movable wall portion (4).

and wherein said compression spring means (18) is positioned between the fixed portion (3) and the elastically movable wall portion (4) and located for exerting resilient spring force in a direction to press the elastically movable wall portion (4) against the doctor blade (11).

5. Construction according to claim 1, wherein the side wall fixed portion (3) is formed with a recess (B) within which the elastically movable wall portion is located, said recess extending parallel to the inner wall of the fixed portion of the side wall, so that the elastically movable wall portion forms, essentially, a continuation of the inner wall of said side wall.

6. Construction according to claim 1, wherein the fixed and the elastically movable wall portions of the side walls are formed with grooves receiving the leg portion of the sealing element (7);

and clamping strips (19, 20) are provided, pressing the leg portion of the sealing element against the respective fixed and movable portions (3, 4) of the side wall.

7. Construction according to claim 1, wherein the elastically movable wall portion includes an end zone adjacent the blade (11), said end zone being inclined at an angle which is at least approximately similar to the angle formed by the blade (11) with the tangent of the duct roller (1) at the approximate engagement point with the duct roller.

8. Construction according to claim 1, wherein the elastically movable wall element is a plate element.

* * * * *

UNITED STATES PATENT AND TRADEMARK OFFICE

CERTIFICATE OF CORRECTION

PATENT NO. : 4,414,900

DATED : November 15, 1983

INVENTOR(S) : Josef JRAUS et al

It is certified that error appears in the above-identified patent and that said Letters Patent is hereby corrected as shown below:

Col.2,line 38 "elastically movable" should read -- elastically movably --

Col.2,line 64 "elastically movable" should read -- elastically movably --

IN THE CLAIMS:

Col. 4, line 29 (claim 1) "duct rather" should read -- duct roller --

Signed and Sealed this

*Seventeenth* Day of *July 1984*

[SEAL]

*Attest:*

GERALD J. MOSSINGHOFF

*Attesting Officer*

*Commissioner of Patents and Trademarks*